US007752783B2

(12) United States Patent
Chen

(10) Patent No.: US 7,752,783 B2
(45) Date of Patent: Jul. 13, 2010

(54) MESSAGE CARD

(75) Inventor: Jen-Lin Chen, 10180 Prado Vista Dr., Cupertino, CA (US) 95014

(73) Assignee: Jen-Lin Chen, Cupertino, CA (US)

( * ) Notice: Subject to any disclaimer, the term of this patent is extended or adjusted under 35 U.S.C. 154(b) by 0 days.

(21) Appl. No.: 12/357,182

(22) Filed: Jan. 21, 2009

(65) Prior Publication Data

US 2009/0183401 A1 Jul. 23, 2009

(30) Foreign Application Priority Data

Jan. 23, 2008 (DE) ..... 20 2008 001 012 U

(51) Int. Cl.
*G09F 1/00* (2006.01)
*A63H 33/38* (2006.01)
*B42D 15/00* (2006.01)

(52) U.S. Cl. ..... 40/124.03; 40/124.11; 446/150; 229/92.8

(58) Field of Classification Search ..... 40/124.03, 40/124.11; 446/150; 229/92.8
See application file for complete search history.

(56) References Cited

U.S. PATENT DOCUMENTS 2,749,657 A * 6/1956 Lohnes ..... 446/150

* cited by examiner

*Primary Examiner*—Joanne Silbermann
*Assistant Examiner*—Syed A Islam

(57) ABSTRACT

A message card includes: a card body having first and second leaves, the card body being foldable and unfoldable in a manner that the first leaf is movable toward and away from the second leaf between closed and opened positions; a mounting base provided on the second leaf; a supporting mechanism mounted on the mounting base and defining two opposite end openings that are spaced apart from each other by a gap; a circuit unit; a switch mounted on the mounting base, coupled electrically to the circuit unit, and having an actuating member extending into the gap; and a flexible driving lever attached to the first leaf, extending through the end openings, and co-movable with the first leaf relative to the second leaf. The driving lever has a driving segment that is received in the gap to drive movement of the actuating member of the switch.

8 Claims, 8 Drawing Sheets

MESSAGE CARD

CROSS-REFERENCE TO RELATED APPLICATION

This application claims priority of German Application No. DE202008001012.8, filed on Jan. 23, 2008.

BACKGROUND OF THE INVENTION

1. Field of the Invention

The invention relates to a message card, more particularly to a message card provided with a supporting mechanism for preventing a driving lever from being flexed upwardly or downwardly.

2. Description of the Related Art

FIG. 1 illustrates a conventional greeting card that includes: a card body 11 having first, second, and third leaves 111, 112, 113, the third leaf 113 covering and being attached adhesively to the second leaf 112; a printed circuit board 12 mounted on the second leaf 112 and defining a circuit; a guiding plate 13 disposed on the printed circuit board 12; a speaker 17 coupled electrically to the circuit; a switch 14 mounted on the printed circuit board 12, coupled to the circuit, and having a spring arm 141, a fixed arm 142 disposed adjacent to the spring arm 141, and an engaging block 143 provided on a free end of the spring arm 141; and a flexible driving lever 15 of a plastic sheet attached to the first leaf 111 through an adhesive tape 16, extending through the guiding plate 13, and formed with a recess 151. The card body 11 is foldable along a folding line 113 such that the first leaf 111 is movable relative to the second leaf 112 between opened and closed positions. At the opened position (see FIG. 1), the engaging block 143 on the spring arm 141 is pressed sidewisely by one edge of the driving lever 15 so as to be flexed resiliently and brought into contact with the fixed arm 142, thereby closing the circuit and permitting activation of the speaker 17. At the closed position (not shown), the recess 151 in the driving lever 15 is moved to a position to receive the engaging block 143 therein, thereby permitting restoration of the spring arm 141 to its non-flexed state so as to separate the spring arm 141 from the fixed arm 142 and to open the circuit and deactivate the speaker 17.

As shown in FIGS. 2 and 3, the conventional greeting card is disadvantageous in that the driving lever 15 is likely to be undesirably flexed upwardly (see FIG. 2) to be disposed over the engaging block 143 or downwardly (see FIG. 3) to be disposed beneath the engaging block 143 by an external force acting on the card body 11 during assembling, handling, packaging or shipping, thereby resulting in malfunctioning of the circuit when the folded card body 11 is opened.

SUMMARY OF THE INVENTION

Therefore, an object of the present invention is to provide a message card that can overcome the aforesaid drawback of the prior art.

According to this invention, there is provided a message card that comprises: a card body having first and second leaves, the card body being foldable and unfoldable in a manner that the first leaf is movable toward and away from the second leaf between closed and opened positions; a mounting base provided on the second leaf; a supporting mechanism mounted on the mounting base and defining two opposite end openings that are aligned in a lever-moving direction and that are spaced apart from each other by a gasp; a circuit unit; a switch mounted on the mounting base, coupled electrically to the circuit unit, and having an actuating member extending into the gap between the end openings of the supporting mechanism; and a flexible driving lever attached to the first leaf, extending in the lever-moving direction through the end openings, and co-movable with the first leaf relative to the second leaf. The driving lever has a driving segment that is received in the gap to contact slidingly the actuating member so as to drive movement of the actuating member of the switch so as to enable deactivation and activation of the circuit unit when the first leaf is moved relative to the second leaf between the opened and closed positions.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
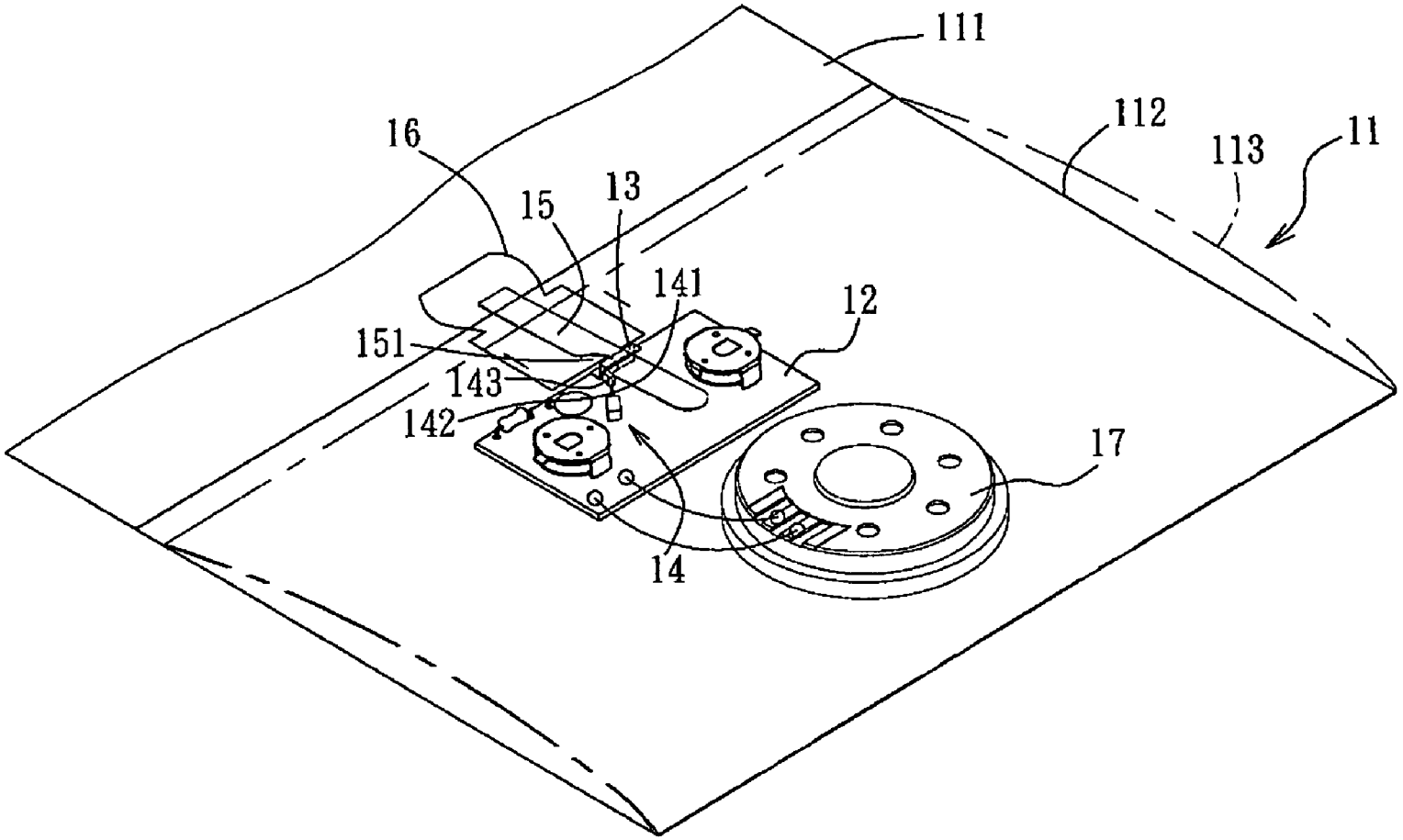
FIG. 1 PRIOR ART
FIG. 1 is a fragmentary schematic view of a conventional folio-type talking card, illustrating a normal state where a card body is disposed at an opened position.
Figure 2:
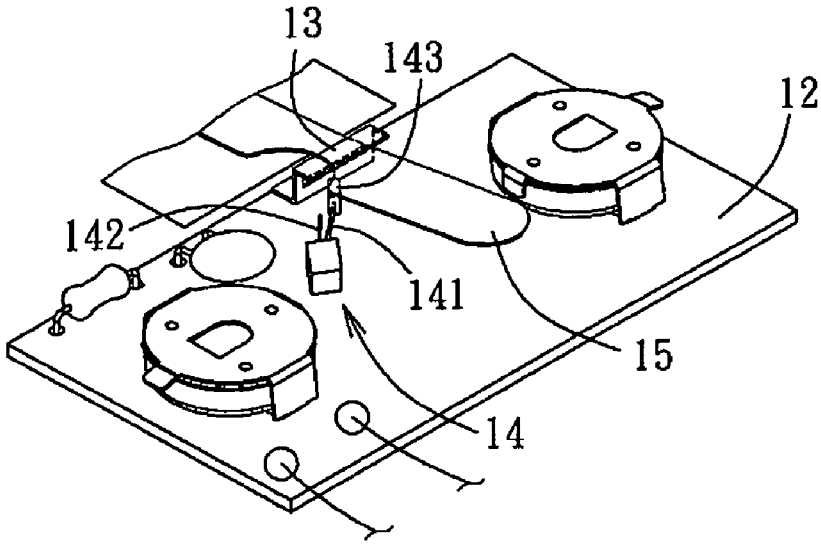
F I G. 2 PRIOR ART
FIG. 2 is a fragmentary schematic view of the conventional folio-type talking card, illustrating an abnormal state where a driving lever is undesirably flexed upwardly by an external force.
Figure 3:
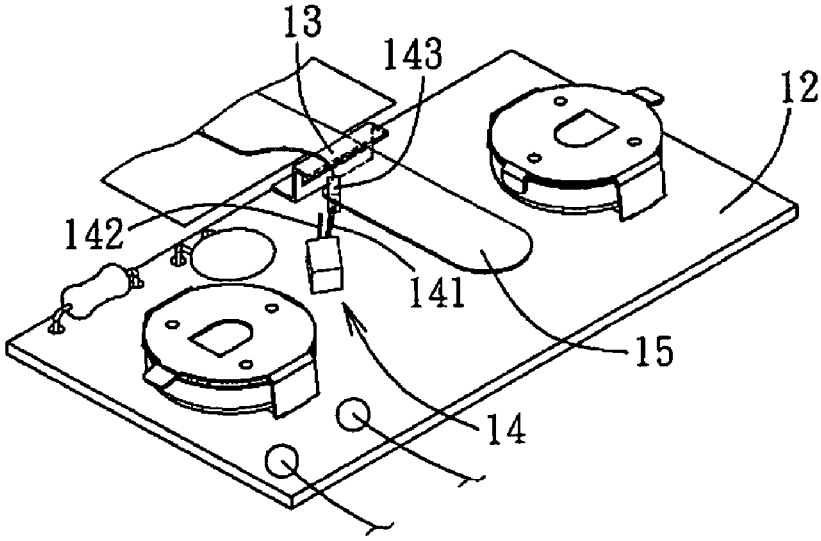
F I G. 3 PRIOR ART
FIG. 3 is a fragmentary schematic view of the conventional folio-type talking card, illustrating another abnormal state where the driving lever is undesirably flexed downwardly by an external force.
Figure 4:
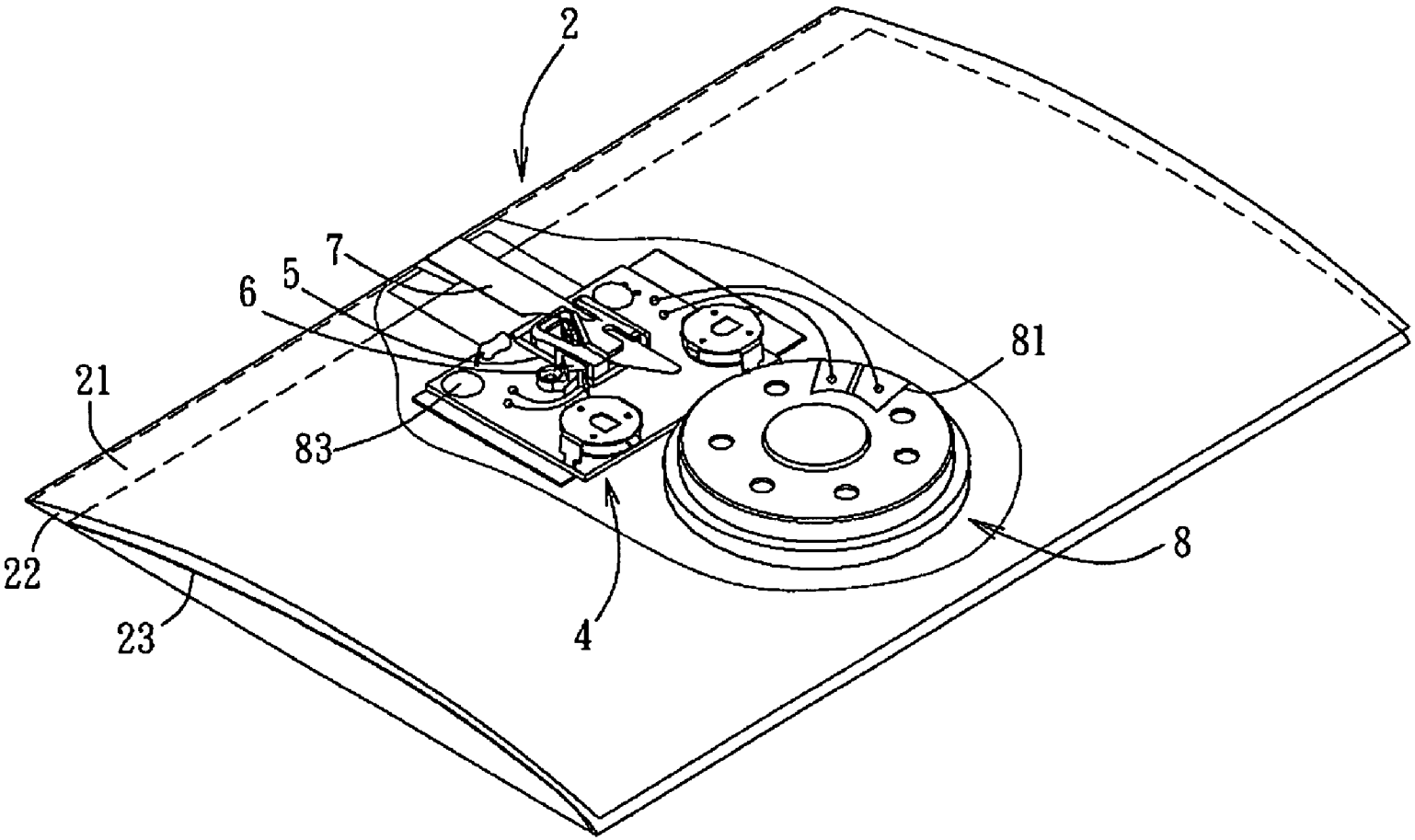
FIG. 4 is a perspective view of the first preferred embodiment of a message card according to this invention.
Figure 5:
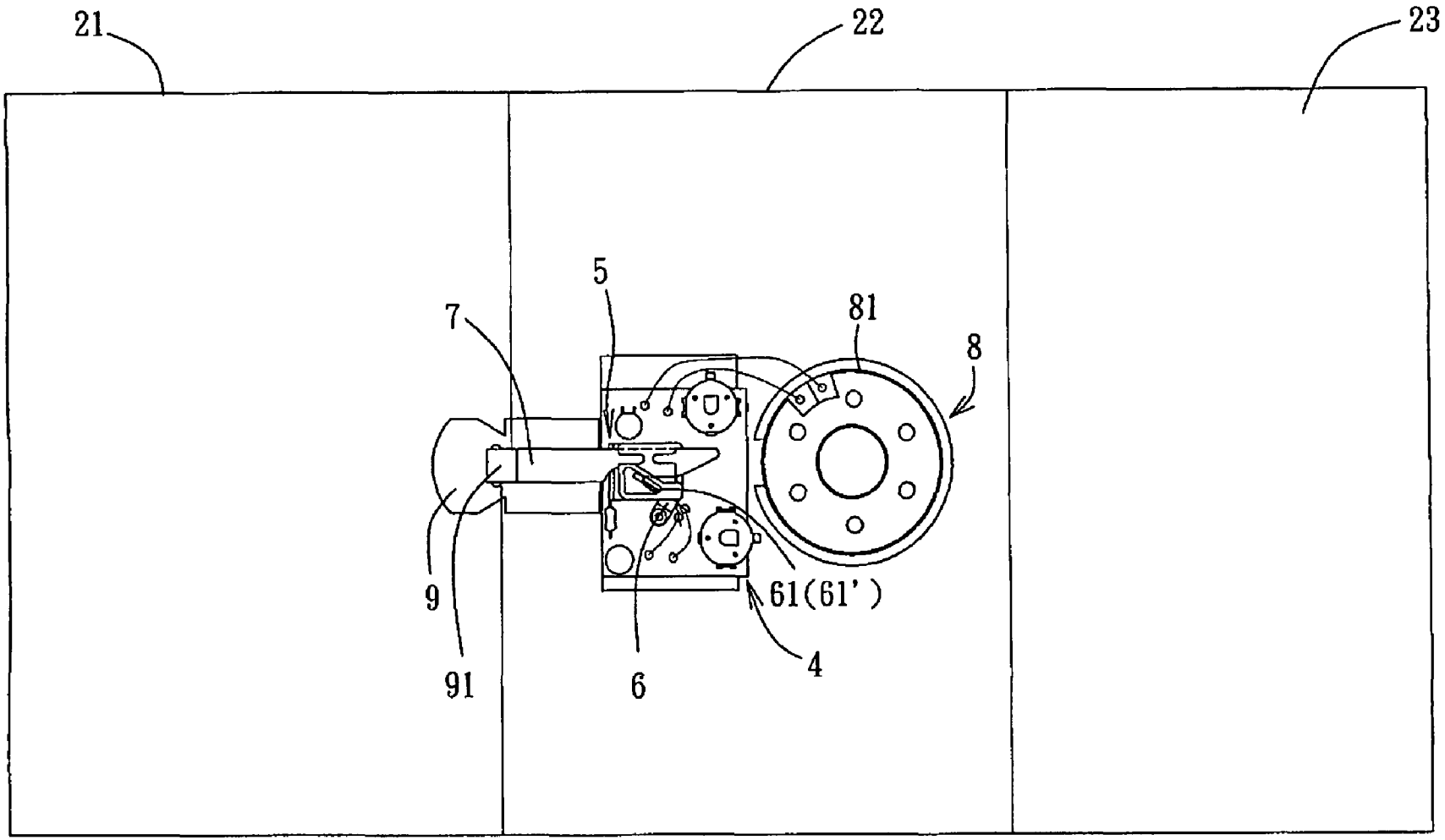
FIG. 5 is a schematic view illustrating the configuration of a card body of the first preferred embodiment.

Before the present invention is described in greater detail with reference to the accompanying preferred embodiments, it should be noted herein that like elements are denoted by the same reference numerals throughout the disclosure.

Figure 9:
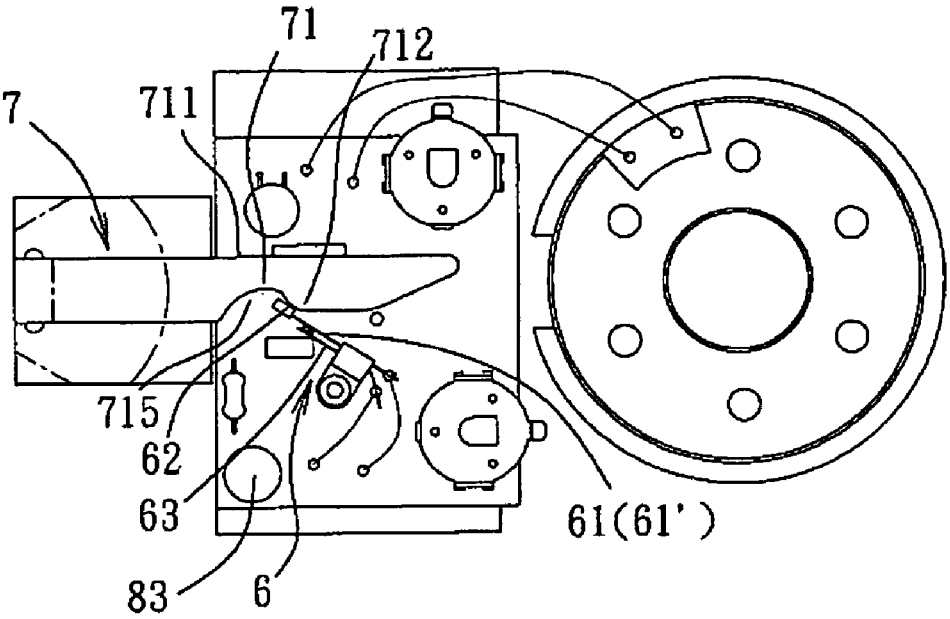
FIG. 9 is a partly sectional view of the first preferred embodiment, illustrating a state where a spring arm has yet to make contact with a fixed arm.
Figure 10:
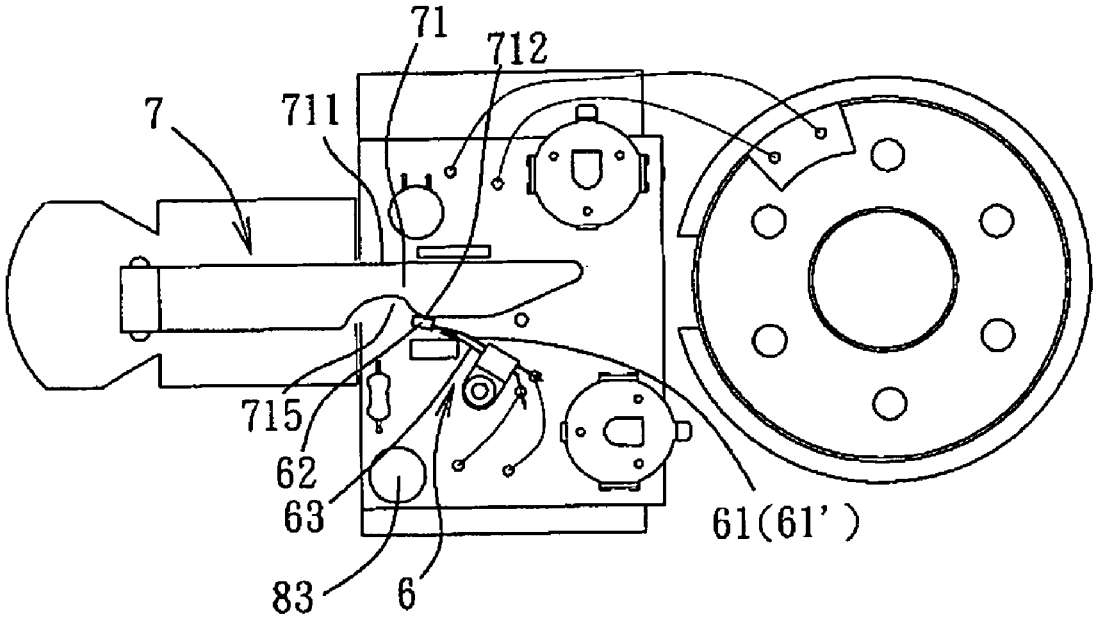
FIG. 10 is a partly sectional view of the first preferred embodiment, illustrating a state where the spring arm is brought into contact with the fixed arm.

FIGS. 4 to 7 illustrate the first preferred embodiment of a message card, such as a greeting card or an invitation card, etc. The message card includes: a folded card body 2 having first, second, and third leaves 21, 22, 23, the card body 2 being foldable and unfoldable along a folding line (not shown) in a manner that the first leaf 21 is movable toward and away from the second leaf 22 between closed and opened positions (see FIGS. 4 and 5); a mounting base 4 provided on the second leaf 22; a supporting mechanism 5 mounted on the mounting base 4 and defining two opposite end openings 51 that are aligned in a lever-moving direction and that are spaced apart from each other by a gap 58; a circuit unit 8; a switch 6 mounted on the mounting base 4, coupled electrically to the circuit unit 8, and having an actuating member 61 extending into the gap 58 between the end openings 51; and a flexible driving lever 7 attached to the first leaf 21, extending in the lever-driving direction through the end openings 51, and co-movable with the first leaf 21 relative to the second leaf 22. The driving lever 7 has a driving segment 71 that is received in the gap 58 to contact slidingly the actuating member 61 so as to drive movement of the actuating member 61 of the switch 6 (see FIGS. 9 and 10) so as to enable deactivation and activation of the circuit unit 8 when the first leaf 21 is moved relative to the second leaf 22 between the opened and closed positions. The third leaf 23 is configured to cover and to be bonded adhesively to the second leaf 22 so as to cover the mounting base 4, the supporting mechanism 5, and the switch 6.

Figure 6:
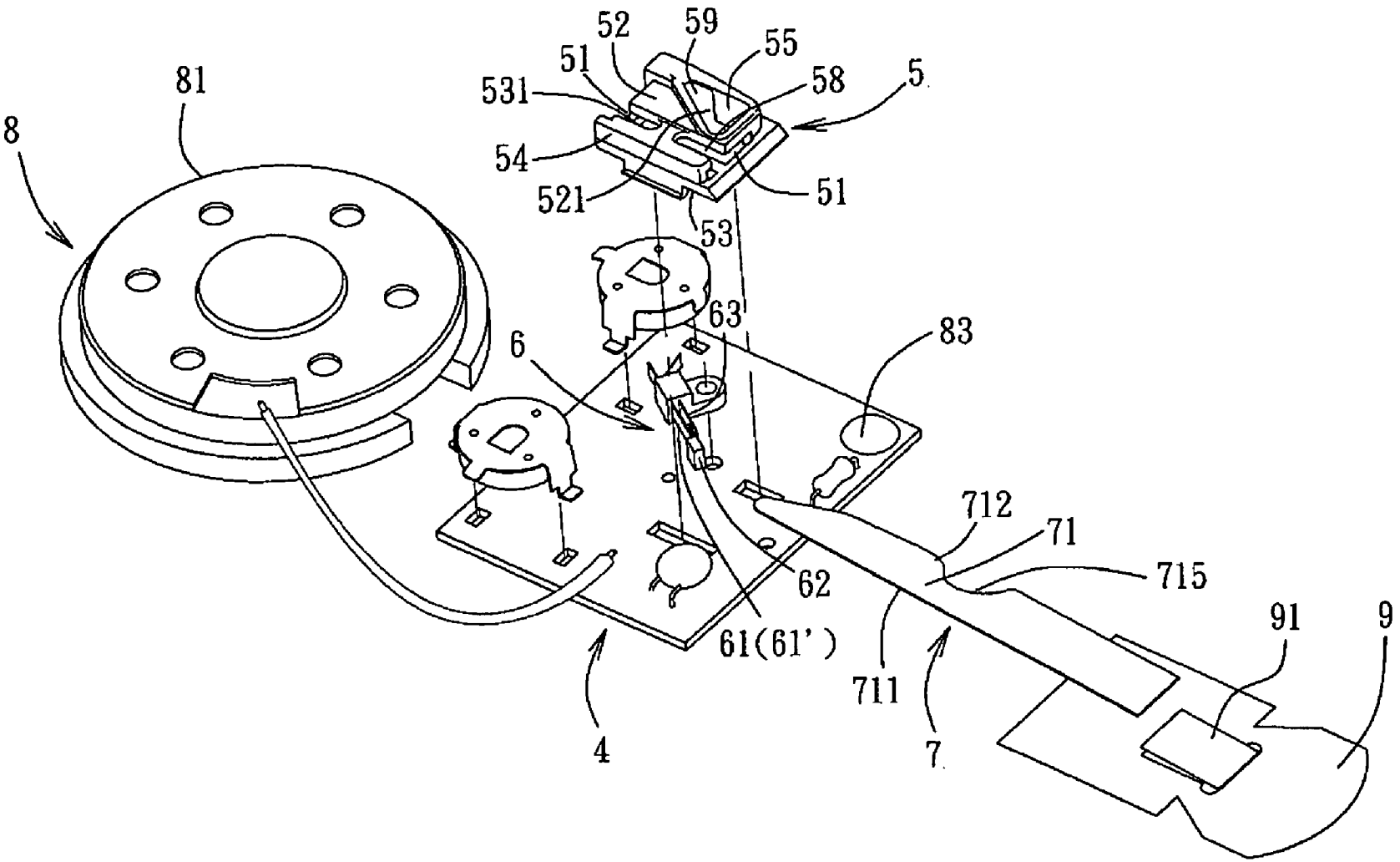
FIG. 6 is a partly exploded perspective view of the first preferred embodiment.
Figure 7:
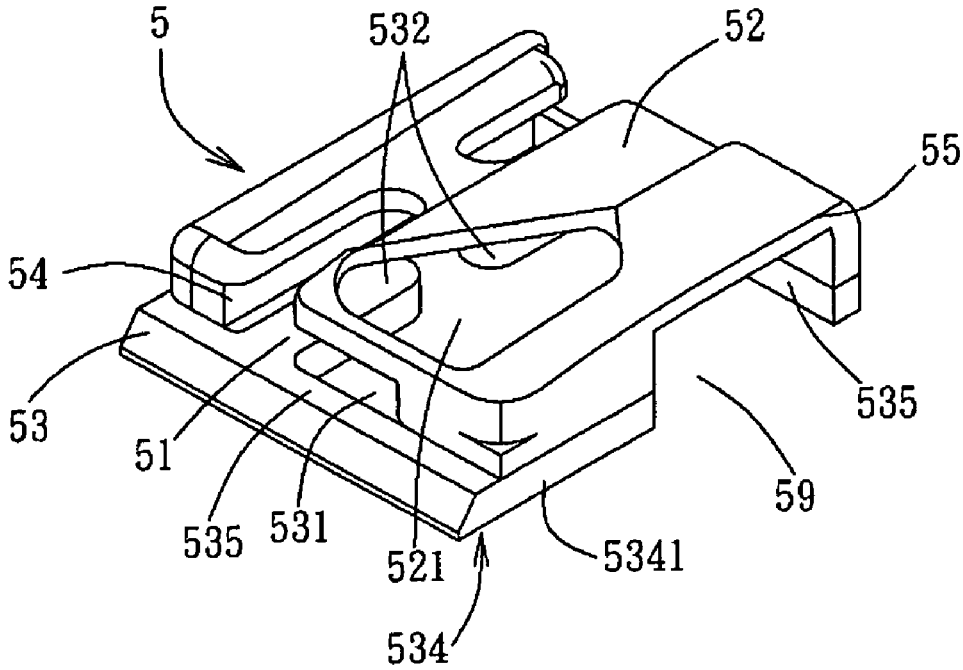
FIG. 7 is a perspective view of a supporting mechanism of the first preferred embodiment.

In this embodiment, the supporting mechanism 5 has top and bottom walls 52, 53 and opposite first and second side walls 54, 55 that are opposite to each other in a transverse direction relative to the lever-driving direction (see FIGS. 6 and 7). The first and second side walls 54, 55 interconnect and cooperate with the top and bottom walls 52, 53 to define the end openings 51 and the gap 58 thereamong. The driving segment 71 of the driving lever 7 is limited by the top and bottom walls 52, 53 so as to prevent the driving lever 7 from being bent upwardly or downwardly, which can result in an undesired condition that the driving lever 7 fails to drive movement of the actuating member 61, when an external force acts on the card body 2 and is transmitted to the driving lever 7 during assembling, handling, packaging, or shipping. The actuating member 61 of the switch 6 extends through the second side wall 55 and into the gap 58 for engaging the driving segment 71 of the driving lever 7 during movement of the first leaf 21 relative to the second leaf 22 between the opened and closed positions.

In this embodiment, the actuating member 61 of the switch 6 is in the form of a spring arm 61' that has a free end provided with an engaging block 62. The switch 6 further has a fixed arm 63 extending into the gap 58 and having a free end disposed adjacent to the free end of the spring arm 61'. The spring arm 61' and the fixed arm 63 are electrically conductive. The driving segment 71 of the driving lever 7 has a first side 711 (see FIGS. 7 and 8) abutting against the first side wall 54 of the supporting mechanism 5, and a second side 712 opposite to the first side 711 and abutting against the engaging block 62 so as to drive movement of the engaging block 62 together with the free end of the spring arm 61' toward and away from the free end of the fixed arm 63 when the first leaf 21 is moved relative to the second leaf 22 between the opened and closed positions. The free end of the spring arm 61' is flexed resiliently by the driving segment 71 of the driving lever 7 to abut resiliently against the free end of the fixed arm 63 when the first leaf 21 is disposed at the opened position (see FIG. 10), and is restored to its non-flexed state to separate from the free end of the fixed arm 63 when the first leaf 21 is disposed at the closed position (see FIG. 9).

Figure 8:
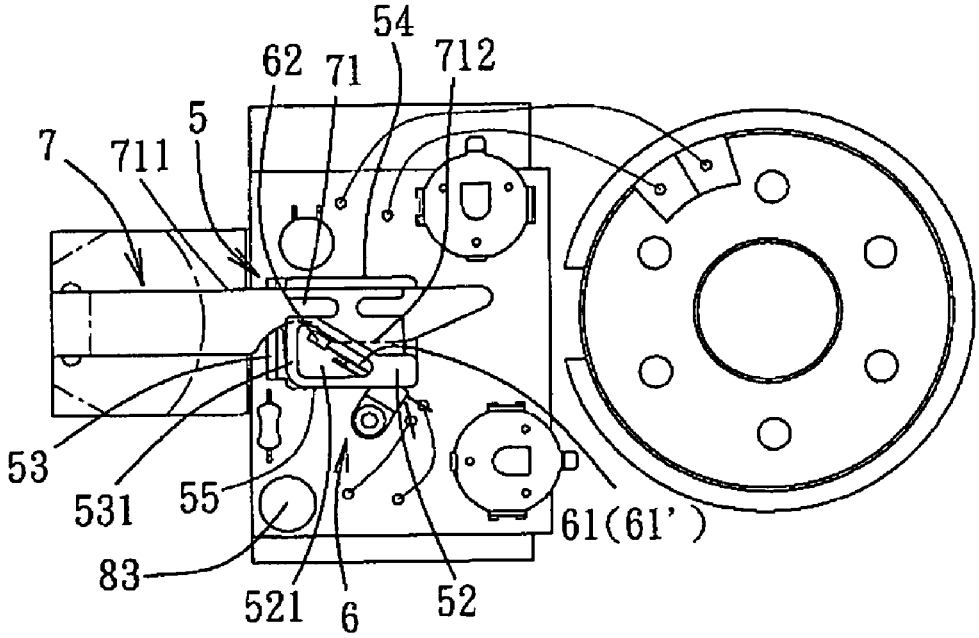
FIG. 8 is a partly sectional view of the first preferred embodiment.

Referring to FIGS. 6 to 8, the top wall 52 of the supporting mechanism 5 is formed with a top opening 521 disposed above the gap 58. The bottom wall 53 of the supporting mechanism 5 is formed with a bottom opening 531 disposed below the gap 58. The engaging block 62 extends into the top and bottom openings 521, 531, i.e., the engaging block 62 has a height greater than that of the gap 58, so as to prevent the driving segment 71 of the driving lever 7 from being disposed over a top side of the engaging block 62 or being disposed beneath a bottom side of the engaging block 62.

The second side 712 of the driving segment 71 of the driving lever 7 is formed with a recess 715. The engaging block 62 is received in the recess 715 (see FIG. 9) to thereby restore the free end of the spring arm 61' to its non-flexed state when the first leaf 21 is disposed at the closed position, and is disposed outwardly of the recess 715 (see FIG. 10) when the first leaf 21 is disposed at the opened position.

The bottom wall 53 of the supporting mechanism 5 has a frame part 534 with opposite first and second sides 535 and a lateral side 5341, and two ribs 532 extending respectively from the first and second sides 535 of the frame part 534 toward each other for confining and guiding movement of the driving segment 71 of the driving lever 7. The second side wall 55 extends from the lateral side 5341 of the frame part 534 of the bottom wall 53 to the top wall 52 of the supporting mechanism 5. The supporting mechanism 5 is formed with a notch 59 extending through the lateral side 5341 of the frame part 534 of the bottom wall 53 and into the second side wall 55. The spring arm 61' extends through the notch 59 and into the gap 58.

In this embodiment, the first leaf 21 is provided with an adhesive tape 9 attached adhesively thereto and having a connecting tongue 91 protruding therefrom. The driving lever 7 further has a fixed end opposite to the free end of the driving lever 7 and attached adhesively to the connecting tongue 91.

In this embodiment, the mounting base 4 is a printed circuit board. The circuit unit 8 includes an IC controller 83 and a sound reproduction device, which is a speaker 81, provided on the second leaf 22 and coupled electrically to the IC controller 83. The speaker 81 is coupled electrically to the switch 6 via the mounting base 4. A memory chip (not shown) is provided on the mounting base 4 and is for storing messages, such as audio music or greetings, such that when the switch 6 is turned on, the speaker 81 is activated and the messages stored in the memory chip can be reproduced through the speaker 81.

Figure 11:
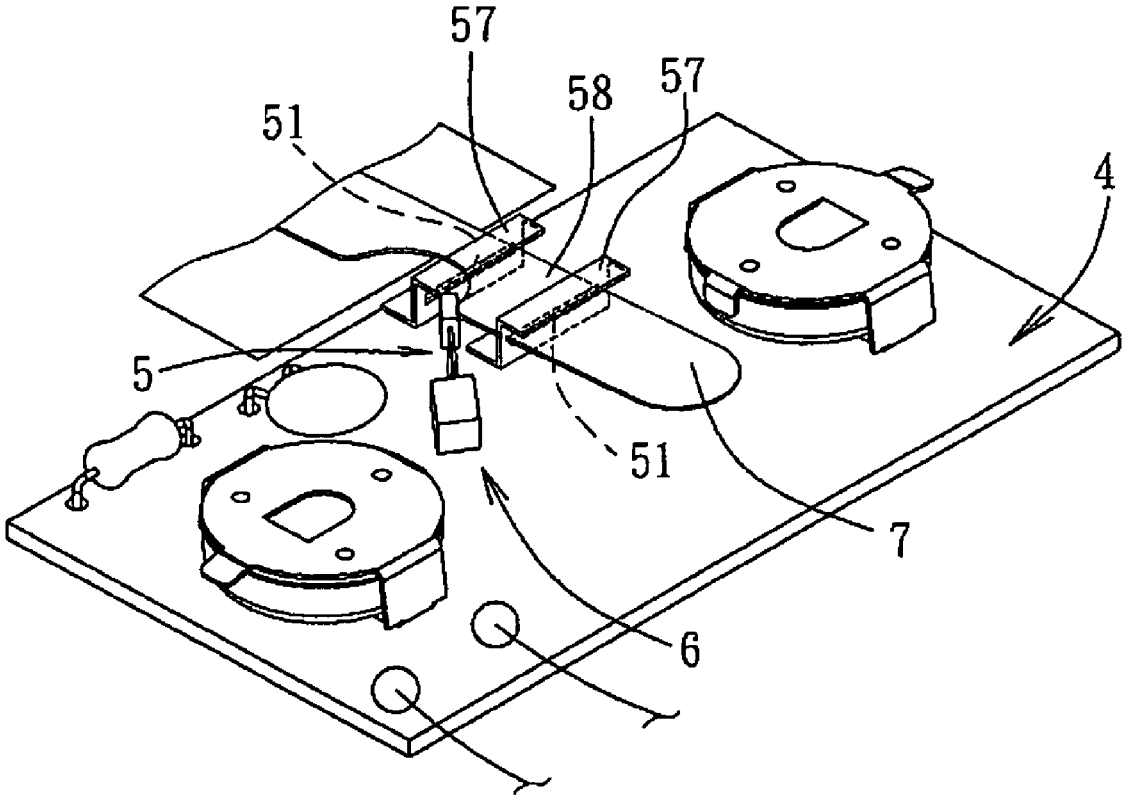
FIG. 11 is a fragmentary schematic view of the second preferred embodiment of a message card according to this invention.

FIG. 11 illustrates the second preferred embodiment of the message card according to this invention. The second preferred embodiment differs from the previous embodiment in that the supporting mechanism 5 includes two opposite guiding plates 57 that are mounted on the mounting base 4, that are formed with the end openings 51 of the supporting mechanism, respectively, and that are spaced apart from each other by the gap 58. Each of the end openings 51 is defined by an opening-defining wall. The driving segment 71 of the driving lever 7 is limited by the opening-defining walls of the end openings 51 to flex upwardly and downwardly.

With the inclusion of the supporting mechanism 5 in the message card of this invention, the aforesaid drawback associated with the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A message card, comprising:

a card body having first and second leaves, said card body being foldable and unfoldable in a manner that said first leaf is movable toward and away from said second leaf between closed and opened positions;

a mounting base provided on said second leaf;

a supporting mechanism mounted on said mounting base and defining two opposite end openings that are aligned in a lever-moving direction and that are spaced apart from each other by a gap, said supporting mechanism having top and bottom walls and opposite first and second side walls that are opposite to each other in a transverse direction relative to the lever-driving direction and that interconnect and that cooperate with said top and bottom walls to define said end openings and said gap thereamong;

a circuit unit;

a switch mounted on said mounting base, coupled electrically to said circuit unit, and having an actuating member extending through said second side wall and into said gap between said end openings of said supporting mechanism; and a flexible driving lever attached to said first leaf, extending in the lever-moving direction through said end openings, and co-movable with said first leaf relative to said second leaf, said driving lever having a driving segment that is limited by said top and bottom walls so as to prevent said driving lever from being bent upwardly and downwardly and that is received in said gap to contact slidingly said actuating member so as to drive movement of said actuating member of said switch so as to enable deactivation and activation of said circuit unit when said first leaf is moved relative to said second leaf between the opened and closed positions.

2. The message card of claim 1, wherein said actuating member of said switch is in the form of a spring arm that has a free end provided with an engaging block, said switch further having a fixed arm extending into said gap between said end openings and having a free end disposed adjacent to said free end of said spring arm, said spring arm and said fixed arm being electrically conductive, said driving segment of said driving lever having a first side abutting against said first side wall of said supporting mechanism, and a second side opposite to said first side and abutting against said engaging block so as to drive movement of said engaging block together with said free end of said spring arm toward and away from said free end of said fixed arm when said first leaf is moved relative to said second leaf between the opened and closed positions, said free end of said spring arm being flexed resiliently by said driving segment of said driving lever to abut resiliently against said free end of said fixed arm when said first leaf is disposed at the opened position, and being restored to its non-flexed state to separate from said free end of said fixed arm when said first leaf is disposed at the closed position.

3. The message card of claim 2, wherein said top wall of said supporting mechanism is formed with a top opening disposed above said gap, said bottom wall of said supporting mechanism being formed with a bottom opening disposed below said gap, said engaging block extending into said top and bottom openings.

4. The message card of claim 2, wherein said second side of said driving segment of said driving lever is formed with a recess, said engaging block being received in said recess when said first leaf is disposed at the closed position, and being disposed outwardly of said recess when said first leaf is disposed at the opened position.

5. The message card of claim 3, wherein said bottom wall of said supporting mechanism has a frame part with a lateral side, said second side wall extending from said lateral side of said frame part of said bottom wall to said top wall of said supporting mechanism, said supporting mechanism being formed with a notch extending through said lateral side of said frame part of said bottom wall and into said second side wall, said spring arm extending through said notch and into said gap.

6. The message card of claim 1, wherein said mounting base is a printed circuit board.

7. The message card of claim 1, wherein said circuit unit includes a sound reproduction device provided on said second leaf.

8. The message card of claim 1, wherein said first leaf is provided with an adhesive tape attached adhesively thereto and having a connecting tongue protruding therefrom, said driving lever further having a fixed end opposite to said free end of said driving lever and attached adhesively to said connecting tongue.

* * * * *